United States Patent [19]

Gaddi

[11] 4,353,406

[45] Oct. 12, 1982

[54] METAL CASTING MACHINE

[75] Inventor: Roberto Gaddi, Turin, Italy

[73] Assignee: Fataluminium S.p.A., Rivoli, Italy

[21] Appl. No.: 184,444

[22] Filed: Sep. 5, 1980

[30] Foreign Application Priority Data

Sep. 17, 1979 [IT] Italy ..... 68824 A/79

[51] Int. Cl.[3] ..... B22D 41/06

[52] U.S. Cl. ..... 164/336; 222/357; 222/629

[58] Field of Search ..... 164/335, 336, 155, 457; 222/629, 604, 605, 357, 356, 166

[56] References Cited

U.S. PATENT DOCUMENTS

| | | | |
|---|---|---|---|
| 2,611,939 | 9/1952 | Kux | 164/336 X |
| 3,398,782 | 8/1968 | Lauterjung | 164/336 |
| 3,977,460 | 8/1976 | Badone et al. | 164/155 |
| 3,979,033 | 9/1976 | Fulton et al. | 164/336 X |
| 4,074,837 | 2/1978 | Engel | 164/336 X |

FOREIGN PATENT DOCUMENTS

| | | | |
|---|---|---|---|
| 1483598 | 11/1969 | Fed. Rep. of Germany | 164/336 |
| 1933284 | 1/1971 | Fed. Rep. of Germany | 222/629 |
| 2155754 | 5/1972 | Fed. Rep. of Germany | 164/335 |
| 2273613 | 1/1976 | France | 222/604 |
| 1375520 | 11/1974 | United Kingdom | 222/604 |

*Primary Examiner*—R. L. Spruill
*Assistant Examiner*—J. Reed Batten, Jr.
*Attorney, Agent, or Firm*—Sughrue, Mion, Zinn, Macpeak & Seas

[57] ABSTRACT

The machine has a casting ladle mounted rotatably on a movable support member which conveys the ladle between a filling station and at least one casting station. The movable member carries a motorized rotary disc cam cooperating with a cam-follower which controls rotations of the ladle. The cam profile includes a larger sector of increasing radius to cause a pouring rotation of the ladle at the casting station and a smaller sector of decreasing radius to cause a return rotation of the ladle to the upright position after casting. The cam has, between the two sections, a profile portion which is re-entrant towards the axis of rotation of the cam and in which the cam-follower is engageable selectively to cause a sharp rotation of the ladle from the upright position to an inverted position, so as to release the skin or crust of solidified metal from the inside of the ladle when the latter is at a cleaning station. Control means are provided for avoiding engagement of the cam-follower in the re-entrant portion at least when the ladle is in the casting station, and for disengaging the cam-follower from the re-entrant portion after the inversion of the ladle.

11 Claims, 13 Drawing Figures

METAL CASTING MACHINE

The present invention relates to a metal-casting machine particularly for casting light alloys.

The invention is concerned particularly with a machine of the type comprising a casting ladle which has a casting spout, a movable support member on which the ladle is mounted for rotation about a horizontal axis which passes substantially through the casting spout, said member being displaceable to convey the ladle between a filling station where the ladle is filled with a charge of molten metal and at least one casting station, and control means carried by the support member and including a motor-driven rotary disc cam and a cam-follower cooperating with the cam and connected to the ladle in such a way as to transform the displacements of the cam-follower into rotations of the ladle, said cam having a peripheral profile which includes, in succession in the normal sense of rotation of the cam, a larger sector and a smaller sector, the larger cam sector having a radius which increases progressively according to a predetermined law to cause the ladle to rotate, at the or each casting station, from an upright position for containment of the molten metal to an inclined position at the end of the casting, in which the spout is lowermost, and the smaller cam sector being of decreasing radius to cause a return rotation of the ladle, in an opposite sense, to the upright position after casting.

A machine of this type is known from U.S. Pat. No. 3,977,460 and is later referred to as 'a machine of the aforesaid type.'

The main advantages of such a machine lie, on the one hand, in the rotation of the ladle about an axis passing substantially through the casting spout and, on the other hand, in the cam-controlled rotation of the ladle during the casting which makes it possible to effect a metered casting operation, in much the same way in which this operation would be performed manually by an expert metal-founder.

After a casting has been performed, that is to say, after the charge of molten metal has been emptied from the ladle, there will inevitably remain on the internal surfaces of the ladle a skin or crust of solidified metal which it is desirable to remove before the ladle is filled again, both in order to clean the ladle and also to recover the metal. The above-mentioned U.S. patent makes no reference to means for performing such a cleaning operation.

It is, however, known practice in manual casting to invert the ladle after pouring the metal therefrom and to strike the ladle forcefully with a hammer or mallet to cause separation of the skin or crust, which falls into an underlying container.

The main object of the present invention is to provide a casting machine of the aforesaid type capable of performing the cleaning of the ladle after each casting operation, without manual intervention, and without recourse to striking of the ladle.

According to the present invention there is provided a machine of the aforesaid type which is characterised in that the ladle support member is movable to convey the ladle additionally to at least one cleaning station, the cam having, between the said smaller sector and larger sector, a re-entrant portion extending towards the axis of rotation of the cam, and the cam-follower being engageable in said re-entrant portion to cause a rapid rotation of the ladle, in the said opposite sense, from the upright position to an inverted position in which the cam-follower engages the bottom of the re-entrant portion of the cam, and in that actuator means act on the cam-follower to prevent its entry into the re-entrant portion at least when the ladle is at the casting solution and to disengage the cam-follower from said re-entrant portion of the cam after inversion of the ladle at the cleaning station.

The invention derives from the observation that the skin or crust of solidified metal which remains in the ladle after casting can be separated from the internal surfaces of the latter solely by the effect of the rapid inversion of the ladle. Such rapid inversion of the ladle, obtained by the re-entrant profiling of the cam, allows cleaning of the ladle at the or each cleaning station without recourse to striking of the ladle manually or by a striker device.

The invention will be further understood from the following description, given by way of non-limiting example, with reference to the attached drawings, in which.

Figures 1, 2:
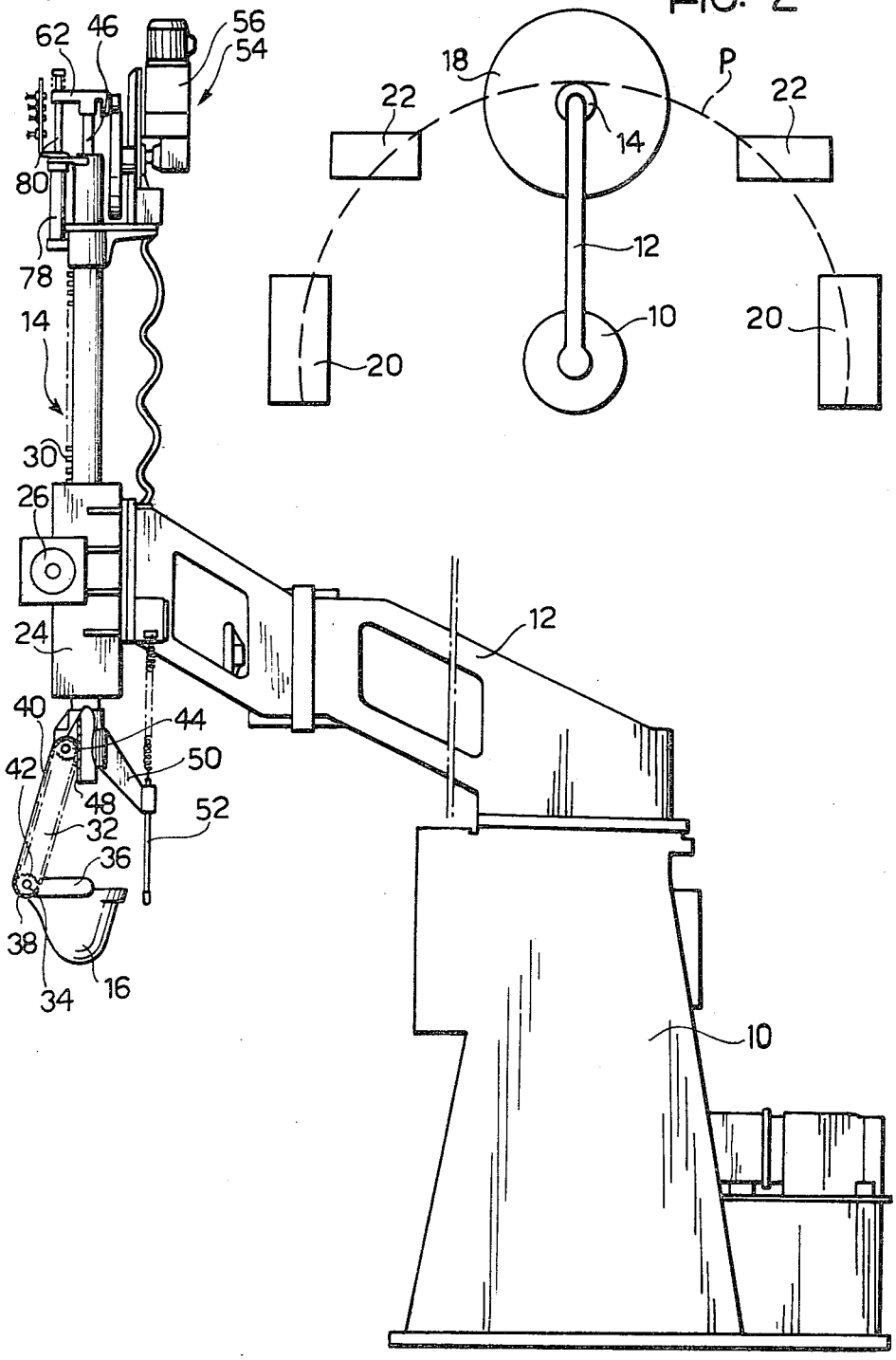
FIG. 1 is a side elevational view of a casting machine according to a first preferred embodiment of the invention.
FIG. 2 is a schematic plan view showing the incorporation of the machine of FIG. 1 in a casting installation.

Referring first to FIGS. 1 and 2, a casting machine for light alloys according to the first illustrated embodiment of the invention includes a base or turret 10 supporting a motorised arm 12 which is rotatable about a vertical axis. The free end of the arm 12 carries a movable ladle support member 14. The support member 14 carries a casting ladle 16 which will be described in detail below.

By swinging the arm 12 on the base 10, the support member 14 can be moved in a circular horizontal path, indicated P in FIG. 2. At the centre of the path P there is an electric furnace 18 which contains a supply of molten light alloy to be cast. At two diametrically opposed ends of the path P there are respective casting stations 20, each provided with one or more casting moulds.

The furnace 18 constitutes a filling station for the ladle 16 as will be described below. Between this filling station and each of the casting stations 20 there is located a respective cleaning station 22 equipped with an upwardly-open receptacle resting on the floor of the work area in which the machine is sited. Each receptacle, as will be better seen below, is intended to receive a skin or crust of solidified light alloy which is made to fall from the ladle 16 after each casting operation at the neighbouring casting station 20.

Each casting cycle staarts with the arm 12 central and the support member 14 at the filling station. The ladle 16 is lowered into the furnace 18 where it is filled with a charge of molten alloy to be cast in the mould or moulds at one of the casting stations 20. When the ladle 16 has been filled, the arm 12 is swung to convey the support member 14 to a position above one of the casting stations 20. The ladle 16 is then tipped so as to pour the molten alloy into the casting mouth of the mould or group of moulds at this casting station 20.

After the casting has been effected, the arm 12 is swung in the opposite sense to carry the ladle 16 to the neighbouring cleaning station 22 where the ladle is inverted to discharge the crust or skin of solidified alloy from the ladle into the receptacle at this station. The ladle 16 is then returned to its upright position and, by a further rotation of the arm 12, it is carried back to the filling station where the ladle is again lowered into the furnace 18 to receive another charge of molten alloy.

The above-described sequence of operations is then repeated with the casting taking place in the mould or moulds disposed at the other casting station 20, and with the subsequent cleaning of the ladle 16 taking place at the other cleaning station 22. During this time, the mould or group of moulds in which the preceding casting was effected is replaced with a fresh mould or moulds, following which the cycle of operations described above is repeated.

Referring to FIG. 1, a vertical guide head 24 is carried at the free end of the arm 12. The head 24 includes a reversible hydraulic motor 26 with its axis horizontal. A tubular shaft 28 is slidable vertically in the guide head 24 and constitutes the main structural element of the movable support member 14. The tubular shaft 28 is provided on one side with a longitudinal toothed rack 30 with which there meshes a toothed pinion (not shown) keyed to the shaft of the reversible hydraulic motor 26. In this way the motor 26 effects controlled raising and lowering of the tubular shaft 28 relative to the guide head 24.

At its lower end, the tubular shaft 28 carries an extension piece 32 supporting at its lower end a rotatable horizontal shaft 34. On the shaft 34 there is keyed an arm 36 which supports the ladle 16. The ladle 16 has a casting spout 38 which lies on or close to the axis of the shaft 34, so that the rotation of the ladle 16 effectively takes place about its spout 38.

An endless transmission chain 40 extends along the extension piece 32 and interconnects a driven sprocket 42 keyed to the shaft 34 and driving sprocket 44 rotatably mounted at the lower end of the tubular shaft 28. Within the tubular shaft 28 a vertically slidable rod 46 is located. The lower part of the rod 46 has a toothed rack 48 which is in mesh with a toothed pinion (not shown) keyed to a horizontal shaft which also carries the sprocket 44, so that, by raising and lowering the rod 46 relative to the shaft 28, the ladle 16 is rotated.

The lower end of the tubular shaft 28 also carries a bracket 50 which supports a level-sensing probe 52 of the conductivity type having a sensitive lower end which is located slightly below the level of the upper rim of the ladle 16 when the latter is in its upright position, as shown in FIG. 1.

Figure 3:
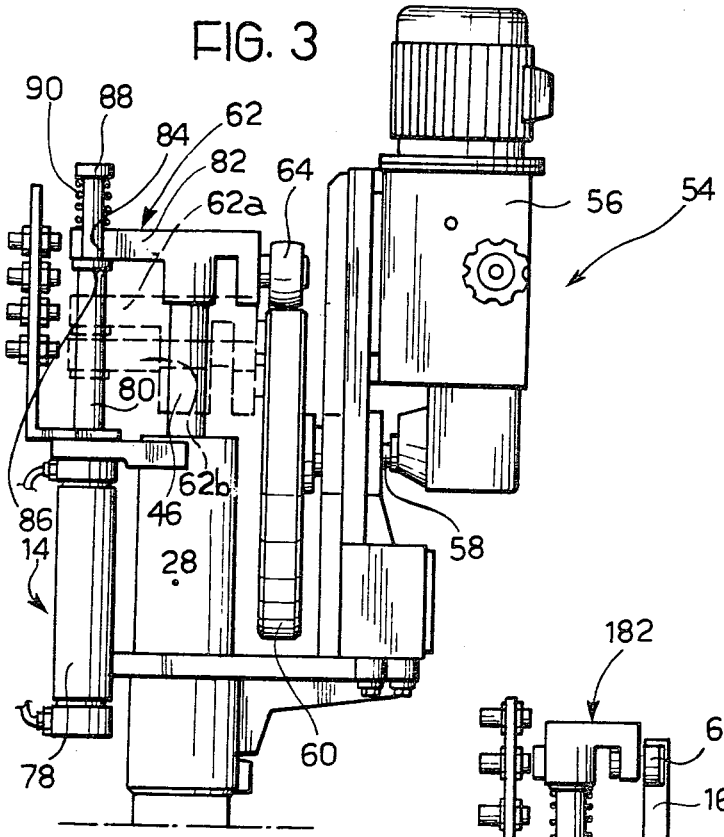
FIG. 3 is a side view on an enlarged scale of an upper part of the machine of FIG. 1.
Figure 8:
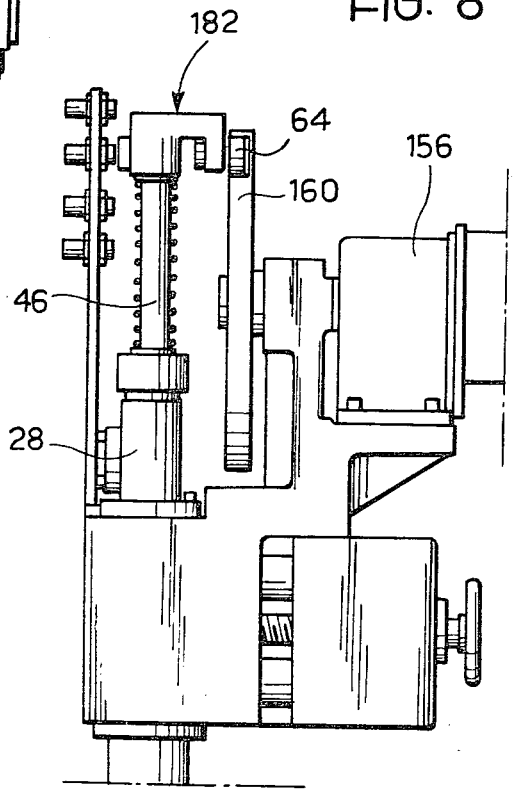
FIG. 8 is a side view, similar to FIG. 3, of a casting machine according to a second embodiment of the invention.

Referring to FIGS. 1 and 3, the upper end of the tubular shaft 28 carries control means, generally indicated 54, which will now be described.

The control means 54 include, inter alia, an electric motor/gearbox unit 56 with a horizontal drive output shaft 58. On the shaft 58 there is keyed a disc cam 60, the shape of which is shown in FIGS. 4 to 7. The motor/gearbox unit 56 rotates the cam 60 in the sense indicated by the arrow F in FIG. 4. The upper end of the rod 46 carries a substantially T-shape head 62 (FIGS. 1 and 3), one branch of which carries a cam-follower roller 64, rotatable about a horizontal axis, which cooperates with the periphery of the cam 60.

The peripheral profile of the disc cam 60 comprises, in succession in the direction of rotation F, a larger sector 66 and a smaller sector 68. The larger sector 66 has a radius which increases progressively, according to a predetermined law, from a point indicated 70 to a point indicated 72 in FIG. 4, while the smaller sector 68 has a radius which decreases from the point 72 to a point indicated 74 in FIG. 4.

Between the point 74 of the smaller sector 68 and the point 70 of the larger sector 66, the cam 60 has a re-entrant profile formed by a radial notch 76 which extends to a position near the axis of rotation of the cam 60.

At the upper end of the tubular shaft 28 there is fixed a double-acting hydraulic actuator 78 having a vertical axis. The actuator 78 has a vertical piston rod 80 which extends upwardly and which is connected to the T-shaped head 62. Thus the head 62 has a branch 82, opposite the branch which carries the cam-follower 64, provided with a sleeved hole 84 in which the actuator rod 80 is slidable vertically. The actuator rod 80 carries a collar 86 located below the branch 82 and also carries, at its upper end, a flange 88. Between the branch 82 and the flange 88 there is interposed a helical compression spring 90 which surrounds the upper end of the rod 80.

The cam-follower roller 64 is maintained in engagement with the upwardly facing edge of the cam 60 by the combined weight of the rod 46 and the head 62 and by the compression force of the spring 90.

Figure 4:
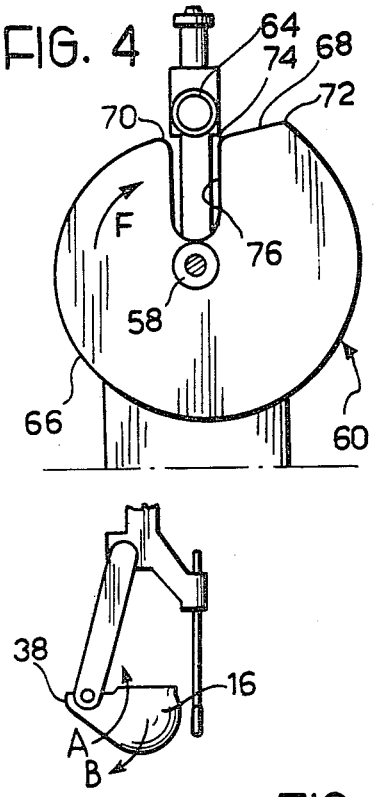
FIGS. 4 to 7 illustrate schematically the operating cycle of the machine of FIG. 1, and include a frontal representation of the cam which forms part of the means for controlling the rotation of the ladle and a diagrammatic representation of the ladle itself at successive stages of the cycle.

Normally, the actuator 78 is extended, raising the rod 80 to the position shown in FIG. 3, in which the collar 86 abuts the branch 82, preventing the cam-follower roller 64 from descending into the notch 76 of the cam in the condition illustrated in FIG. 4.

The actuator 78 can be retracted to move the rod 80 into two lower positions, permitting the head 62 to descend to corresponding lower positions, indicated **62*a* and 62*b* in FIG. 3**, for the purpose which will be explained.

A cycle of operation of the machine will now be described in detail.

It will be assumed that the machine is initially in the condition illustrated in FIG. 4 and in continuous lines in FIG. 3, with the cam-follower roller 64 above the notch 76, but prevented from descending into the latter by the engagement of the collar 86 of the extended actuator rod 80 with the head 62. The corresponding vertical position of the rod 46 is such that the ladle 16 is disposed in an upright position, as shown in FIG. 1.

Assuming that the ladle 16, in this condition, is full of molten light alloy and is located at one of the casting stations 20, the motor/gearbox unit 56 is energised to cause the cam 60 to rotate in the sense indicated by the arrow F. The larger sector 66 of the cam profile engages the cam-follower roller 64 at the point 70 and causes the rod 46 to rise progressively, producing a rotation of the ladle 16 in the sense indicated by the arrow A (FIG. 4). In this way the edge of the ladle 16 opposite the spout 38 is lifted progressively and the molten alloy pours from the spout 38 into the underlying mould or group of moulds at the casting station.

The variation of the radius of the cam sector 66 is predetermined experimentally in such a way as to obtain, during pouring, a rate of flow of the molten alloy from the spout 38 which is constant or variable as required.

Figure 5:
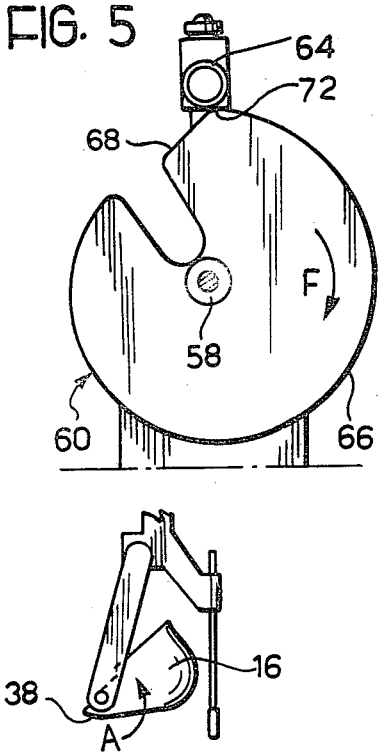

At the end of casting, the cam-follower roller 64 is in engagement with the end point 72 of maximum radius of the cam sector 66, and the ladle 16 is in a condition of maximum inclination, with the spout 38 lowermost, illustrated in FIG. 5. This condition corresponds to the substantially complete emptying of the ladle 16, leaving on the internal surfaces of the latter a skin or crust which solidifies almost immediately.

The cam 60 continues to rotate in the direction of the arrow F and the cam-follower roller 64 engages the smaller sector 68 of the cam, with consequent lowering of the head 62 and of the rod 46. The ladle 16 thus returns to the condition of FIG. 4. During this time the arm 12 is swung so as to carry the ladle 16 from the casting station 20 to the neighbouring cleaning station 22.

When the ladle 16 is located above the receptacle at the cleaning station 22, the actuator 78 is retracted fully to lower the rod 80, allowing the head 62 to descend further to its lowermost position **62*b* (FIG. 3) as the cam follower roller 64 is lowered to the bottom of the notch 76**.

Figure 6:
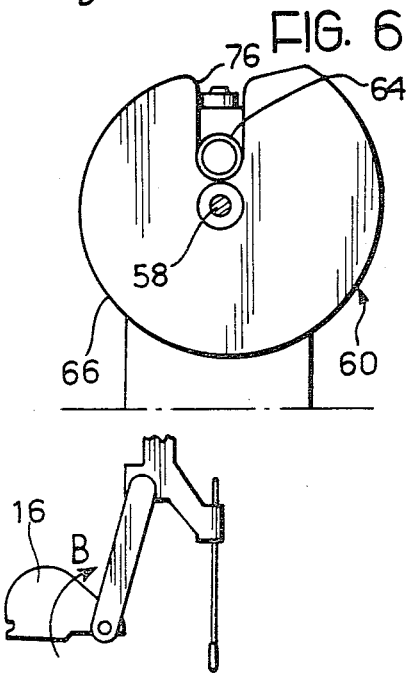

The descent of the cam-follower roller 64 and of the rod 46 result in a rotation of the ladle 16 in the direction of the arrow B, opposite to the direction A, to a final position, illustrated in FIG. 6, in which the ladle 16 is completely inverted. This descent of the rod 46 takes place in a very short time: for example, whilst the lifting of the rod 46 during the casting operation may take of the order of 15 seconds, the lowering of the rod 46 to effect inversion of the ladle 16 may take place in a time of the order of 1.5 seconds. This rapid inversion causes, as has been established, the total separation from the ladle of the skin or crust of solidified alloy, which falls into the underlying receptacle at the cleaning station.

Figure 7:
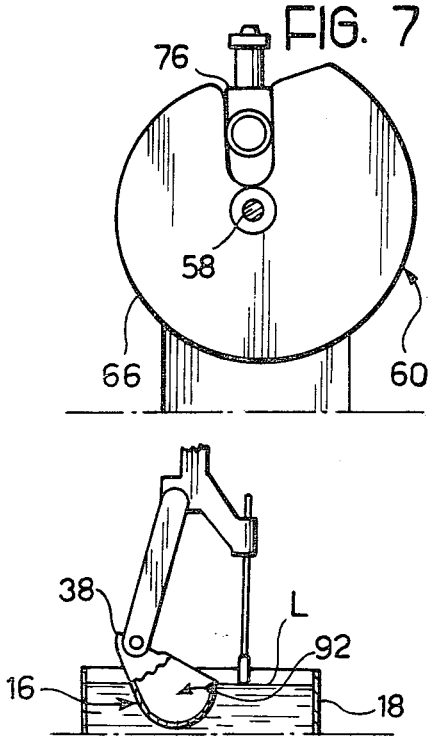

Subsequently, the actuator 78 is extended, raising the rod 80, the head 62 and the rod 46 to their initial positions (FIG. 4). The arm 12 is then swung further to carry the support member 14 over the furnace 18 at the filling station. At this station the member 14 is lowered by energisation of the motor 26 until the probe 52 comes into contact with the molten alloy L contained in the furnace 18 (FIG. 7), when the motor 26 is de-energised and the lowering of the member 14 stopped. The actuator 78 is then retracted to an intermediate position in which the head 62 is in the position **62*a* (FIG. 3) and the cam-follower roller 64 is at an intermediate position in the notch 76, as illustrated in FIG. 7. In this filling position the ladle 16 is slightly inclined backwardly, that is to say, its edge opposite the spout 38 is lower than the spout itself. This edge has a molten metal filling slit 92. In the filling position the slit 92 is located slightly below the level of the molten alloy L which, in the space of several seconds, fills the ladle 16 through the slit 92**.

When the filling is completed, the actuator 78 is extended, under control of a timer, to lift the rod 80 to the position illustrated in full lines in FIG. 3 so that the whole system returns to the starting conditions shown in FIGS. 3 and 4. At the same time the support member 14 is raised by the operation of the motor, and a new casting cycle commences with the displacement of the arm 12 and the member 14 towards the casting station 20 opposite that in which the casting was previously performed.

The embodiment described above is convenient in the case of castings of rather large dimensions, in which each casting cycle is rather long. For castings of small dimensions, however, the second embodiment illustrated in FIGS. 8 to 13 is preferred.

In FIGS. 8 to 13 those parts which are the same as or similar to those of FIGS. 1 to 7 have been indicated with the same reference numerals, whilst the parts which are similar, but which have different functions, have been indicated by the same reference numerals increased by 100.

Thus, the second embodiment has a cam 160 which, like the cam 60 of the first embodiment, has a larger sector 166 to progressively increasing radius similar to the sector 66, and a smaller sector 168 of sharply decreasing radius. The cam 160 also has a re-entrant portion formed by an arcuate groove 176 of spiral profile in one face of the cam. The groove 176 subtends substantially 180° at the axis of rotation of the cam 160 and has a mouth which is located in the region where the smaller cam sector 168 joins the larger cam sector 166. The groove 176 has a closed end nearer the axis of rotation of the cam 160, the said closed end leading in the normal direction of rotation of the cam 160, again indicated by arrow F.

Figure 9:
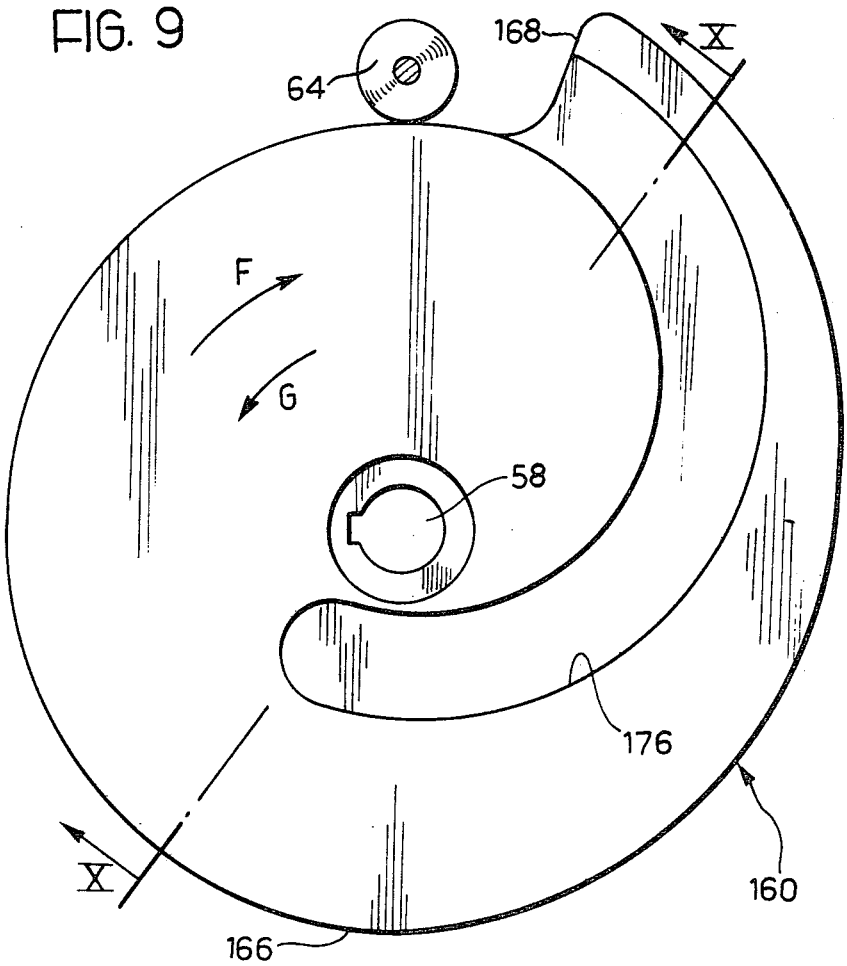
FIG. 9 is a front view on an enlarged scale of the cam forming part of the control means of the machine according to FIG. 8.
Figure 10:
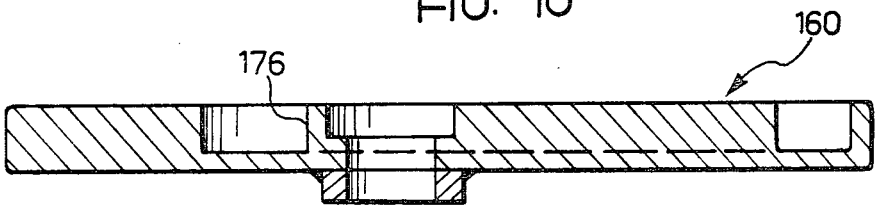
FIG. 10 is a transverse cross section of the same cam, taken on the line X—X of FIG. 9, and FIGS. 11 to 13 are schematic representations, similar to FIGS. 4 to 7 respectively, illustrating the operating cycle of the machine shown in FIG. 8.
Figure 11:
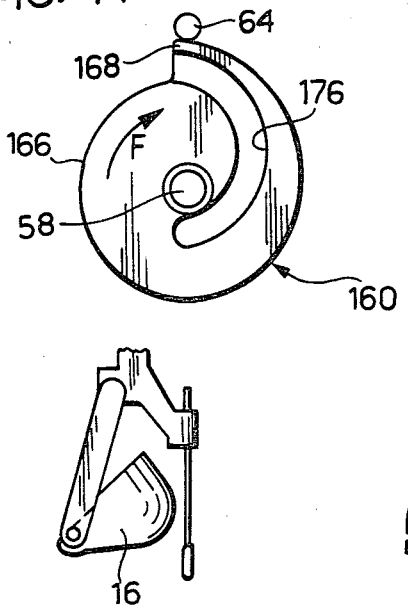

With the cam-follower roller 64 situated as shown in FIG. 9 near the mouth of the groove 176, the conditions of the machine correspond to those of FIG. 4, in which the ladle 16 is upright, at the beginning or end of a casting operation.

Figure 12:
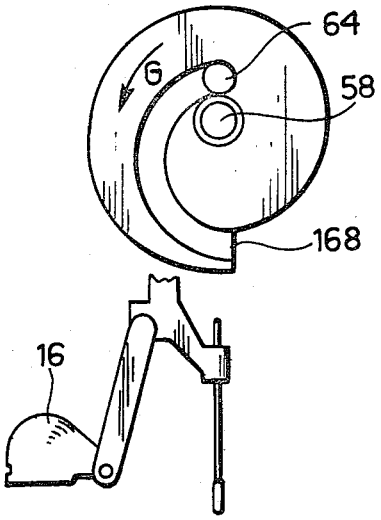

The motor/gearbox unit 156 (not shown in FIGS. 9–13) is provided with a reversible DC motor which, after casting has been effected and when the ladle 16 is located at one of the cleaning stations 22, is operated in the reverse sense to drive the cam 160 in the opposite direction (arrow G) and at high speed compared with its speed in the forward direction F. The cam-follower roller 64 then enters the spiral groove 176 and moves to the closed end of the latter, as illustrated in FIG. 12, drawing the cam-follower roller 64 downwards to its lowermost position and causing inversion of the ladle 16. To obtain the separation of the skin or crust of solidified alloy from the ladle 16, this operation takes place, as before, in a relatively short time of the order of 1.5 seconds.

Figure 13:
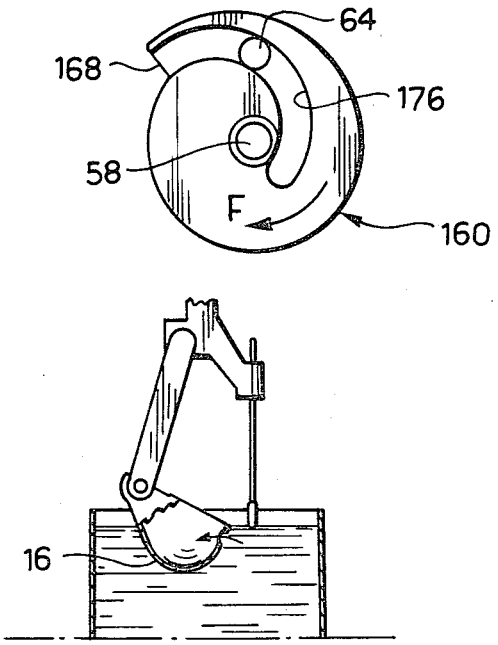

The motor/gearbox unit 156 is then operated to rotate the cam 160 in the sense indicated by the arrow F and is stopped when the cam-follower roller 64 is located in an intermediate position along the length of the groove 176, when the ladle 16 will have a rearwardly-inclined disposition for filling (FIG. 13). The operations of withdrawal of the molten alloy from the furnace 18 then take place as described previously with reference to FIG. 7.

Once the charge of alloy has been withdrawn, the motor/gearbox unit 156 is again driven to rotate the cam 160 in the normal direction of rotation F until the starting condition of FIG. 9 is again reached, when the ladle 16 is carried to one of the casting stations 20 and the cycle of operations is repeated.

The embodiment of FIGS. 8 to 13 has the advantage of allowing a more rapid casting cycle, although involving a greater expense due to the necessity of using a reversible DC motor with its associated control means rather than a more economical hydraulic actuator.

What is claimed is:

1. A metal-casting machine of the type comprising:

a casting ladle having a casting spout, a movable support member on which the ladle is mounted for rotation about a horizontal axis passing substantially through the casting spout, means for displacing said support member to convey the ladle between a filling station where the ladle is filled with a charge of molten metal and at least one casting station, and control means carried by the support member and including a motor-driven rotary disc cam and a cam-follower cooperating with said cam and connected to the ladle to transform the displacements of the cam-follower into rotations of the ladle, said cam having a peripheral profile which includes, in succession in the normal sense of rotation of the cam, a larger sector and a smaller sector, the larger cam sector having a radius which increases progressively to cause the ladle to rotate, at the or each casting station, from an upright position containing the molten metal to an inclined position, at the end of the casting, in which the spout is lowermost, and the smaller cam sector being of decreasing radius to cause a return rotation of the ladle, in an opposite sense, to the upright position after casting, wherein the improvements comprise, in combination:

the means for displacing said ladle support member being effective to convey the ladle additionally to at least one cleaning station, said cam having, between said smaller sector and said larger sector, a re-entrant portion extending towards the axis of rotation of the cam, said cam-follower being engageable in said re-entrant portion to cause a rapid rotation of the ladle, in the said opposite sense, from the upright position to an inverted position in which the cam-follower engages the bottom of said re-entrant portion, and actuator means acting on the cam-follower to prevent its entry into the re-entrant portion at least when the ladle is at the casting station and to disengage the cam-follower from said re-entrant portion of the cam after inversion of the ladle at the cleaning station.

2. Casting machine as in claim 1, wherein said means for displacing the support member are effective to displace said support member both horizontally to convey the ladle between the filling and the or each casting station and also vertically to lower the ladle into a bath of molten metal at the filling station, and wherein said actuator means acting on the cam-follower allow the latter to move into said re-entrant portion of the cam to a position in which the ladle has rotated in the said opposite sense from the upright position to a rearwardly inclined position for withdrawing the ladle from the bath, in which an edge of the ladle opposite the spout is lower than the spout, said actuator means disengaging the cam-follower from the re-entrant portion of the cam after the ladle has been withdrawn from the molten metal.

3. Casting machine as in claim 1 or 2, wherein the cam-follower is movable in a radial direction with respect to the axis of rotation of the cam, said re-entrant portion of the cam being defined by a radial notch terminating near said axis of rotation, and wherein the actuator means include an engagement member movable in the said radial direction into engagement with an abutment movable with the cam-follower, such that displacement of the engagement member radially towards the axis of rotation of the cam allows the cam-follower to engage in the notch and displacement of the engagement member in the opposite sense positively disengages the cam-follower from the notch.

4. Casting machine as in claim 3, wherein the axis of rotation of the cam is horizontal and the cam-follower rests on an upper surface of the cam, the said radial direction of movement of the cam-follower being vertical.

5. Casting machine as in claim 4, wherein the actuator means include a linear actuator having a vertical rod slidable in a hole in the movable abutment, said engagement member comprising a collar carried by the rod and engageable with the underside of the abutment.

6. Casting machine as in claim 5, wherein the actuator rod has an end flange and including a compression spring surrounding the rod and interposed between said movable abutment and said flange, said spring allowing vertical movement of the cam-follower in engagement with the two cam sectors while engaging the cam follower positively in the notch when the actuator rod is lowered.

7. Casting machine as in claim 1 or claim 2, including means for rotating the cam selectively in opposite senses, wherein the re-entrant portion of the cam comprises a substantially spiral arcuate groove formed in one face of the cam and having a mouth adjacent the edge of the cam and a closed end which is nearer the axis of rotation of the cam than said mouth, said closed end leading in the normal sense of rotation of the cam, and wherein the control means cause rotation of the cam in the opposite sense from the normal sense to engage the cam follower in the said spiral groove.

8. Casting machine as in claim 1 or claim 2, wherein the means for displacing the support member include a horizontally displaceable support structure and wherein the support member includes a tubular shaft slidable vertically in a said support structure and carrying said control means and said ladle at its upper and lower ends respectively, and a rod slidable vertically in the tubular shaft and carrying at its upper end the cam-follower, said rod having a lower part provided with a toothed rack, and further including a toothed pinion meshing with said rack and connected to the ladle to effect rotation thereof.

9. Casting machine as in claim 8, wherein the tubular shaft is provided with a toothed rack and including a toothed pinion meshing with said rack and connected to a reversible motor for effecting controlled raising and lowering of the tubular shaft, said motor being carried by the support structure.

10. Casting machine as in claim 8, wherein the support structure comprises a motor-driven arm rotatable about a vertical axis.

11. Casting machine as in claim 8, wherein the ladle is carried by an extension piece which extends from the lower end of the tubular shaft, and including an endless transmission chain connecting the ladle to the pinion which meshes with the toothed rack of the rod, said endless transmission chain extending along the extension piece.

* * * * *